US006269749B1

(12) United States Patent
Hogg

(10) Patent No.: US 6,269,749 B1
(45) Date of Patent: Aug. 7, 2001

(54) CANTILEVERED ROLLER COASTER SYSTEM

(76) Inventor: John J Hogg, 1217 Yale St., (#106), Santa Monica, CA (US) 90404

( * ) Notice: Subject to any disclaimer, the term of this patent is extended or adjusted under 35 U.S.C. 154(b) by 0 days.

(21) Appl. No.: 09/356,489

(22) Filed: Jul. 19, 1999

(51) Int. Cl.[7] ..... B61B 5/00

(52) U.S. Cl. ..... 104/53; 104/63; 104/124

(58) Field of Search ..... 104/53, 56, 63, 104/64, 65, 66, 123, 124, 125, 139; 105/33, 178

(56) References Cited

U.S. PATENT DOCUMENTS 965,768 * 7/1910 Sant ..... 104/139
1,702,136 * 2/1929 Sawers et al. ..... 104/139
3,791,308 * 2/1974 Hartz ..... 104/139
5,778,796 * 7/1998 Kim ..... 104/139
6,047,645 * 4/2000 Cornwell et al. ..... 104/124

* cited by examiner

*Primary Examiner*—Mark T. Le
(74) *Attorney, Agent, or Firm*—Andrus, Sceales, Starke & Sawall

(57) ABSTRACT

An amusement ride includes a lower track structure operably connected with and variably spaced from an upper track structure to define a path of travel for a ride vehicle supported remote from the track structure. A motion translation arrangement is located between the track structure and the ride vehicle for separately or simultaneously varying the distance and angular position of the ride vehicle relative to the track structure in response to at least one of the changing track roll angle and changing gauge of the track structure over a travel path. A drive mechanism is provided for moving the motion translation arrangement and the ride vehicle relative to the track structure.

20 Claims, 7 Drawing Sheets

FIG. 2
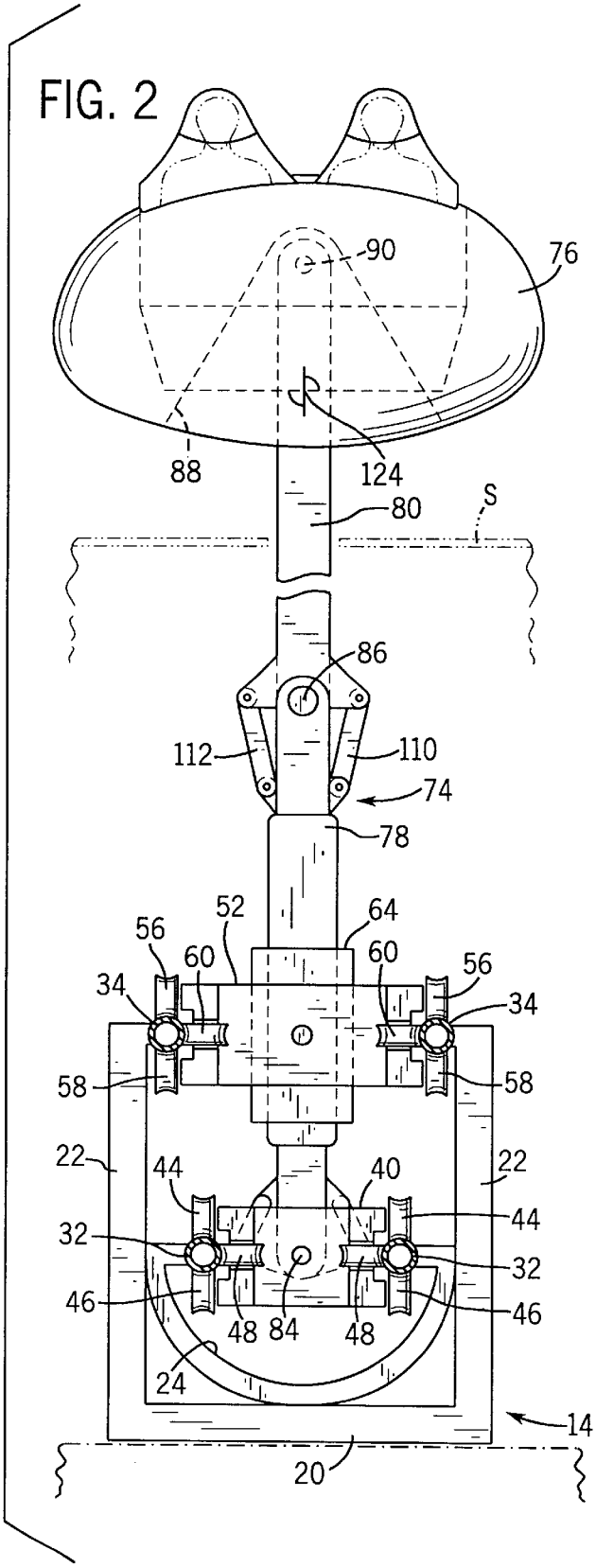
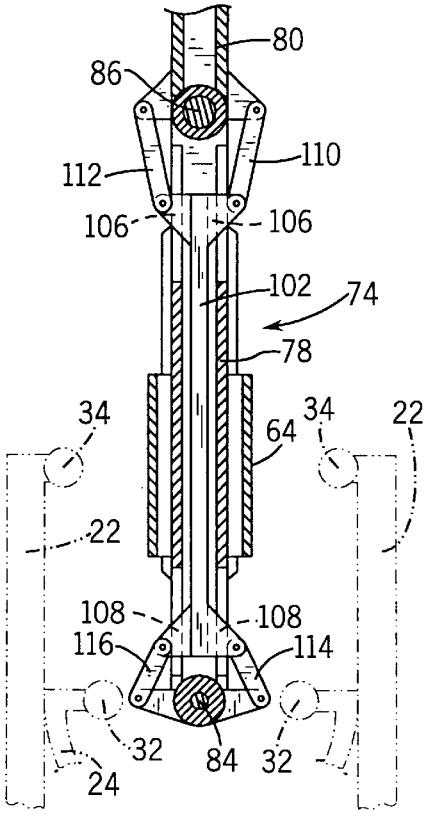
FIG. 3

80
86
110
106
112
106
64
34
102
78
108
114
32
108
116
84
32
34
90
124
76
S
80
86
110
112
64
56
34
28
14
60
52
56
58
30
34
78
26
60
58
44
40
48
32
48
44
28
32
46
84
36
30
30
24
26
46
12
26
28

80
86
110
102
78
104
7
66
70
56
54
60
58
62
52
38
34
72
68
46
42
40
114
116
48
36
32
82
44

70
64
66
94
96
98
92
104
102
100

FIG. 10
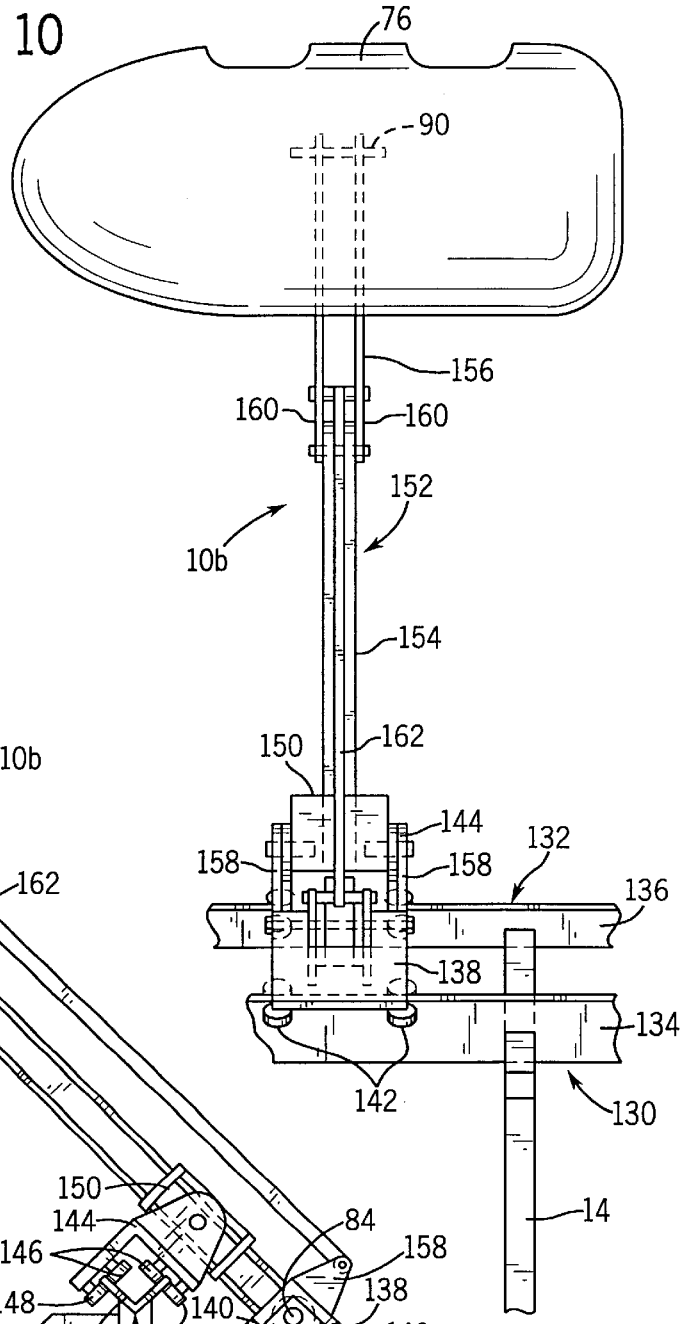
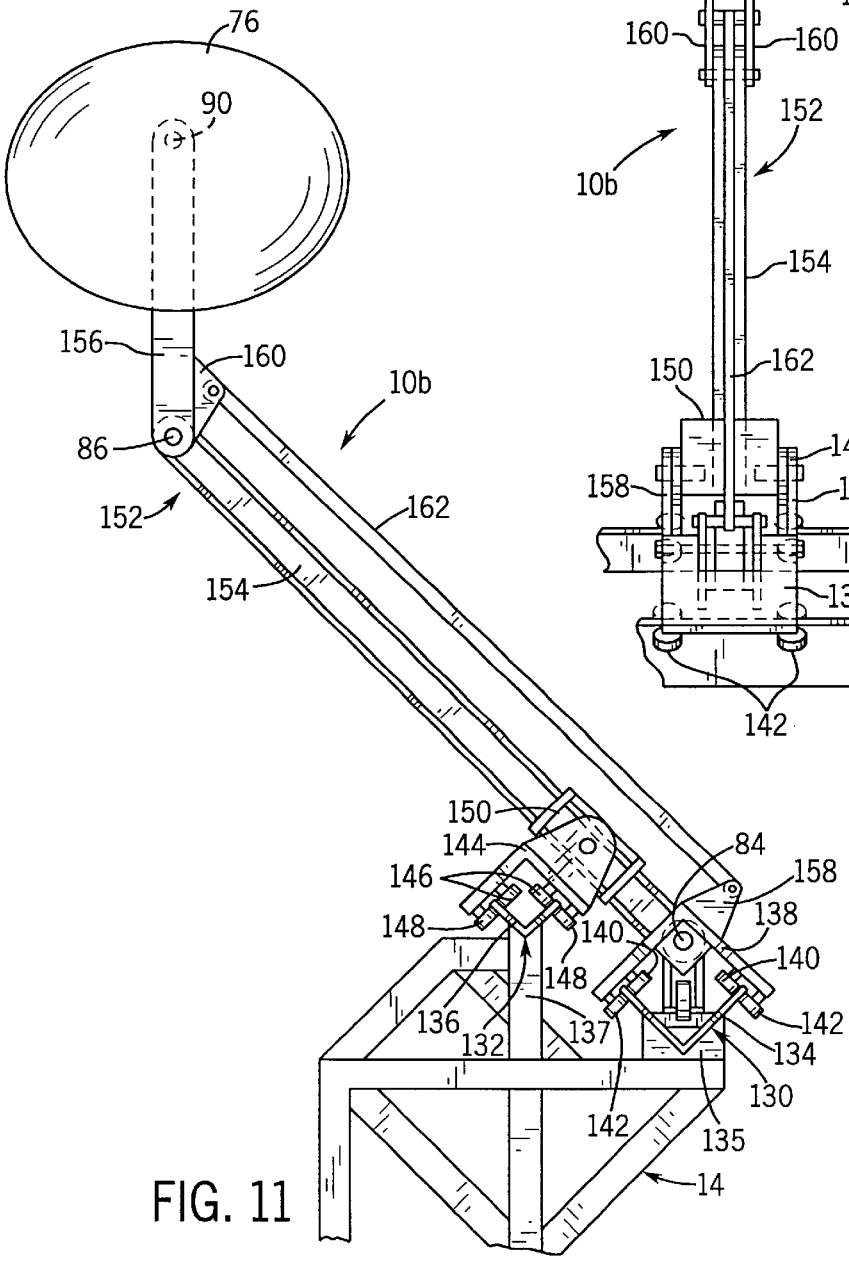
FIG. 11

CANTILEVERED ROLLER COASTER SYSTEM

FIELD OF THE INVENTION

This invention relates broadly to a dynamic amusement or thrill ride of the type wherein a passenger-carrying ride vehicle is caused to move along a track structure in a generally closed loop with more or less inclined portions and a series of curves. More particularly, the invention pertains to a cantilevered roller coaster system which enhances the sensation of motion and travel experienced by passengers in the ride vehicle.

BACKGROUND AND SUMMARY OF THE INVENTION

Amusement parks are enjoying a continuously increasing success throughout the country, as well as throughout the rest of the world. These parks offer their guests a wide range of attractions, the most popular and most spectacular of which is certainly recognized as the roller coaster. Traditionally, roller coasters comprise one or more ride vehicles traveling along rails or tracks in the manner of a train. The passengers appreciate this attraction for the strong impressions which it produces beyond the real sensations of acceleration along the path of travel. That is, these rides also attempt to incorporate a feeling of dizziness or fear and an illusion of risk. Traditional roller coasters enable thrilling motions along loops, spirals and curves to be integrated into the ride.

Another type of ride comprises a vehicle supported on and guided along a track structure. The side mounting of the ride vehicle on the track may provide passengers with the sensation that the ride vehicle does not ride on a track structure and seems free from any mechanical tether to any visible or predetermined course. However, because of the need to maintain control and safety of the ride vehicles, the most severe spirals and loops designed into traditional roller coasters have not typically been present in these alternate ride systems. As a result, the range of sensations offered to passengers is reduced with the passengers' sensation of motion generally dictated by the velocity, acceleration and positioning of the ride vehicle in direct juxtaposition to its path of travel. When it was technically impossible to increase the ride experience of such ride systems, themeing of rides was used to present amusing and entertaining backdrops, scenery, lighting, sound and other special effects.

Notwithstanding these attempts to amplify the thrill of a ride in roller coasters and in alternate ride systems, there remains a definite need for an amusement ride that is capable of enhancing the overall sensation of the motion and travel experienced by a passenger as the ride vehicle moves along its particular track structure. That is, it remains desirable to provide an amusement ride which creates an impression of free flight and keeps the track structure away from the passenger sight line. There also exists a need to provide an amusement ride which permits the ride vehicle to be accelerated in ways uncommon to prior art roller coaster designs.

It is one object of the present invention to provide a roller coaster system which is useful with varying track structure.

It is another object of the present invention to provide an amusement ride which is subject to acceleration along a path perpendicular to the ride vehicle path.

It is also an object of the present invention to provide a cantilevered roller coaster design which is capable of employing various supporting strut configurations.

Another object of the present invention is to provide an amusement ride for varying the position of a ride vehicle relative to the track structure.

Still another object of the present invention is to provide a thrill ride for translating motion along the track structure to a ride vehicle in order to heighten the total ride experience.

In one aspect of the invention, an amusement ride includes a lower track structure operably connected with and variably spaced from an upper track structure to define a path of travel having a changing curvature and/or a changing gauge. A ride vehicle is supported remote from the track structure, and a motion translation arrangement is located between the track structure and the ride vehicle for varying one or both the distance and angular position of the ride vehicle relative to the track structure in response to at least one of the changing curvature and changing gauge of the track structure over the travel path. A drive mechanism is provided for moving the motion translation arrangement and the ride vehicle relative to the track structure.

In one embodiment, the lower track structure includes a pair of parallel lower tracks and the upper track structure includes a pair of parallel upper tracks, the lower and upper tracks having respective center lines spaced apart a variable distance over the path of travel. Each of the lower and upper tracks is tubular and has a circular cross section. The lower and upper tracks are disposed on a support structure located upon a horizontal plane. The motion translation arrangement includes a primary chassis supported for rolling movement along the lower tracks, a secondary chassis supported for rolling movement along the upper tracks, a fulcrum pivotably mounted relative to the secondary chassis and a strut arrangement having a lower end pivotably attached to the primary chassis and an upper end pivotably connected to the ride vehicle, the strut arrangement being mounted for sliding movement back and forth through the fulcrum.

The primary chassis and the secondary chassis are each supported along their respective lower and upper tracks by a set of upper, lower and lateral rollers. The strut arrangement is comprised of an upper tubular strut section and a lower tubular strut section. The lower strut section is pivotably anchored at a bottom end on the primary chassis at a first pivot point lying along the lower track center line and extends upwardly through the fulcrum. The lower strut section has a top end pivotably connected at a second pivot point to a lower end of the upper strut section. The upper strut section has an upper end pivotably connected with a third pivot point on the ride vehicle. The angle of the upper strut section supporting the ride vehicle relative to the lower strut section is varied by the angular rotation of the primary chassis relative to the lower strut section about the first pivot point. This causes the ride vehicle to accelerate through a circular arc about the second pivot point, the acceleration being determined by the rate of change of the angular rotation.

The interior of the lower strut section includes a pair of sliding push rods, each of the rods having an upper end and a lower end. A pair of upper link arms pivotally connects the upper ends of the push rods to the upper strut section, and a pair of lower link arms pivotally connects the lower ends of the push rods to the primary chassis. The push rods and link arms act in a pantographic arrangement permitting any angular rotation of the lower strut section relative to the primary chassis around the first pivot point to be translated to the upper strut section and the ride vehicle. The primary chassis is provided with a rotatable and ratcheted cog wheel which is engageable with a driven link chain to form the drive mechanism for moving the motion translation arrangement and the ride vehicle along the upper and lower track structure. The ride vehicle has a center of gravity arranged to permit the ride vehicle to come to rest in an upright position after being acted upon by centrifugal forces such as executed in a curve of the travel path. The lower strut section includes a flanged, box-beam having a pair of parallel flanged walls engageable with a set of upper and lower pinch rollers mounted inside the fulcrum. A pair of transverse walls connects with the flanged walls and is engageable with a set of upper and lower support rollers mounted inside the fulcrum between the pinch rollers.

In another embodiment, the strut arrangement is comprised of a single tubular strut having a bottom end pivotably anchored at a first pivot point to the primary chassis and extending upwardly through the fulcrum. The single strut section has a top end pivotally attached to a second pivot point on the ride vehicle. The interior of the single strut section includes a pair of sliding push rods, each of the rods having an upper end and a lower end. A pair of upper link arms pivotally connects the upper ends of the push rods directly to the ride vehicle. A pair of lower link arms pivotally connects the lower ends of the push rods to the primary chassis in a pantographic arrangement permitting any angular rotation of the primary chassis around the lower track center line to be translated directly to the ride vehicle.

In yet another embodiment, the lower track structure and the upper track structure are V-shaped in cross section. The motion translation arrangement includes a primary chassis rollably supported along the lower track structure, a secondary chassis rollably supported along the upper track structure, a fulcrum pivotably mounted relative to the secondary chassis, and a strut arrangement having a lower end pivotally attached to the primary chassis and an upper end pivotably mounted to the ride vehicle. The strut arrangement is mounted for sliding movement back and forth through the fulcrum. The strut arrangement is comprised of an upper strut section and a lower strut section pivotably anchored to the primary chassis at a first pivot point lying along the lower track structure center line and extending upwardly through the fulcrum. The lower strut section has a top end pivotally connected at a second pivot point to a lower end of the upper strut section. The upper strut section has an upper end pivotably connected to the ride vehicle. A pair of upper bell cranks is mounted on the upper strut section, a pair of lower bell cranks is attached to the primary chassis and an elongated link arm extends substantially parallel to the lower strut section and is joined between the upper bell cranks and the lower bell cranks. The primary chassis and the secondary chassis are supported along their lower and upper track structure by a set of upper and lower rollers.

In another aspect of the invention, a cantilevered roller coaster system includes a support structure for supporting a lower track structure and an upper track structure, the lower and upper track structures defining a variably curved path of travel. The lower and upper track structures have respective center lines spaced apart a variable distance over the path of travel. A ride vehicle is supported remote from the upper and lower track structure. A primary chassis is supported for movement along the lower track structure, and a secondary chassis is mounted for movement along the upper track structure. A fulcrum is pivotally mounted relative to the secondary chassis. A strut arrangement has a lower end pivotably attached to the primary chassis and an upper end pivotably connected to the ride vehicle. The strut arrangement is mounted for sliding movement back and forth through the fulcrum. With this construction, as the rotational position of the primary chassis around its centerline (which coincides with the first pivot) changes with rotational translation or roll of the lower track along a course of the tracks, the strut arrangement imparts a change in the angular position of the ride vehicle with respect to the tracks. Further, as the distance between or gauge of the upper and lower tracks changes along a course of the tracks, the strut arrangement will slide in the fulcrum and change the position of the ride vehicle linearly along the strut with respect to the tracks.

In yet another aspect of the invention, a roller coaster amusement ride has a compound track structure defining a travel path for a ride vehicle supported remote from the track structure and driven along the travel path. The improvement resides in a dual track structure and a motion translation arrangement located between the track structure and the ride vehicle for varying the distance and angular position of the ride vehicle relative to the track structure in response to the changing curvature, roll and/or gauge of the track structure over the travel path.

Still another aspect of the invention relates to a thrill ride having upper and lower track structures and respective center lines therefor. The track structure is of changing curvature defining a travel path for a ride vehicle supported remote from the track structure and driven along the travel path. The improvement resides in a mechanism for varying the distance between the respective center lines (i.e. gauge) of the upper and lower track structure for varying the rate of acceleration along an axis perpendicular to the travel path as determined by the rate of change of the distance between the respective center lines of the upper and lower track structure over the travel path.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 2 is an elevational view of the roller coaster system taken from the left side of FIG. 1;

FIG. 3 is a fragmentary, sectional view showing details of a sliding push rod and linkage structure employed in the roller coaster system of FIGS. 1 and 2;

FIG. 10 is a view similar to FIG. 1 showing a second alternative embodiment of the invention;

FIG. 11 is a view similar to FIG. 4 but employing the second alternative embodiment of FIG. 10;

DETAILED DESCRIPTION OF THE INVENTION

Figure 1:
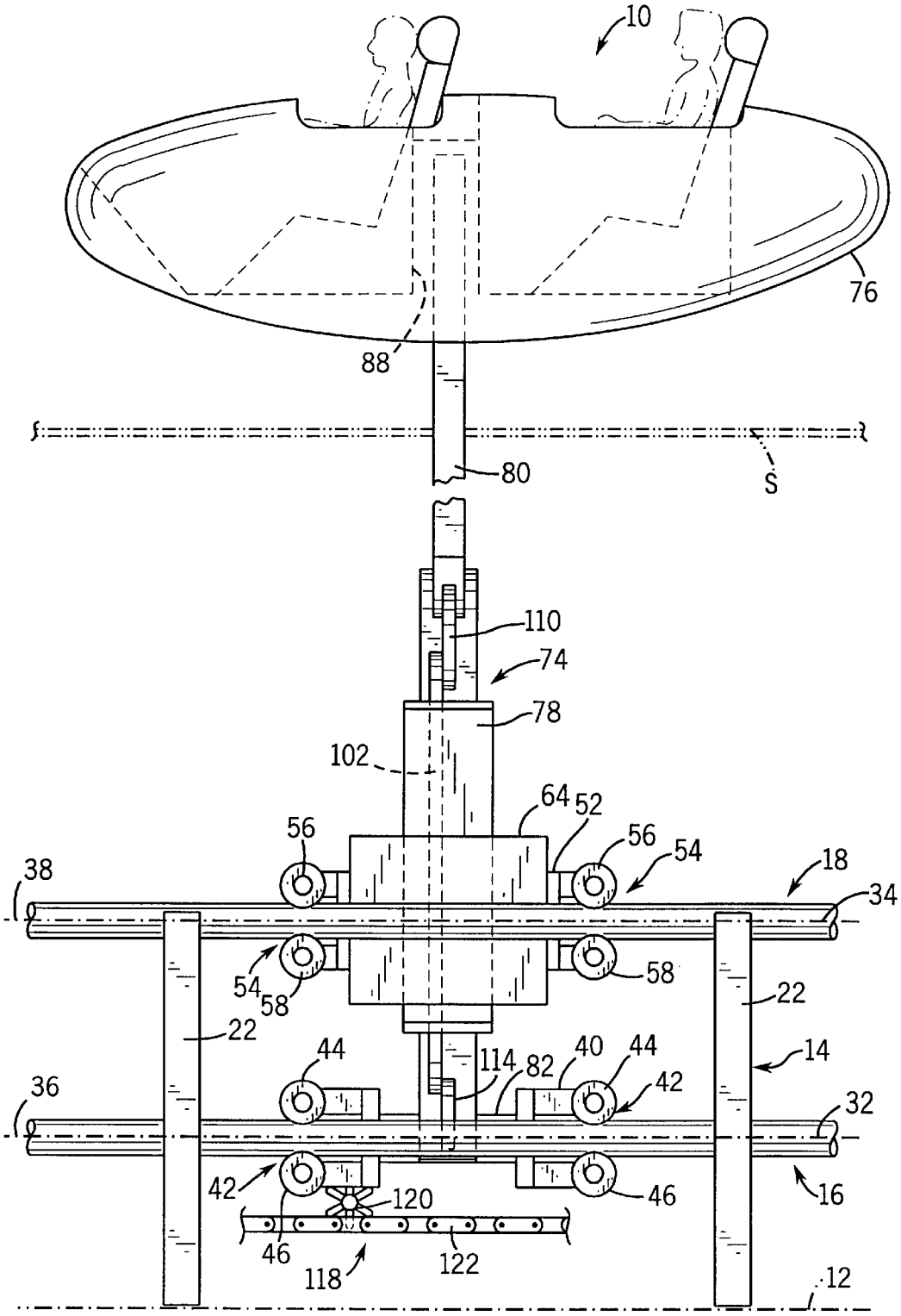
FIG. 1 is a partial, side elevational view of a roller coaster system according to the present invention.

Referring now to FIGS. 1–7, there is shown a preferred embodiment of an amusement or thrill ride in the form of a cantilevered roller coaster system 10. The system 10 is anchored to a horizontal plane 12, such as the ground, by a support structure 14 that supports a compound dual track structure comprising a lower track structure 16 and an upper track structure 18 in a particular relationship thereon. The track structures 16,18 define a variably-shaped closed loop and path of travel which may have a series of straight segments and a series of curved segments, the curved segments including horizontal, vertical and compound curves.

The support structure 14 has a plurality of sections, each of which is generally U-shaped in cross section and comprised of a bottom bight portion 20 which interconnects the lower ends of a pair of parallel uprights 22. The top ends of the uprights 22 are rigidly connected to the upper track structure 18. Support structure 14 also includes an interior substructure 24 which, in the embodiment shown, is semicircular in cross section and fixedly supports the lower track structure 16. In other segments of the travel path, the support structure 14 is typically expanded to include a variety of interconnected vertical, horizontal and angular components 26,28,30, respectively, for positively bolstering the track structures 16,18.

Preferably, the lower track structure 16 includes a pair of parallel, lower tracks 32 and the upper track structure includes a pair of parallel, upper tracks 34. The lower and upper tracks 32,34 have respective center lines 36,38 spaced apart a distance or gauge that varies over the path of travel, as will be described in greater detail. The tracks are typically formed of a tubular shape having a circular cross section.

Figure 6:
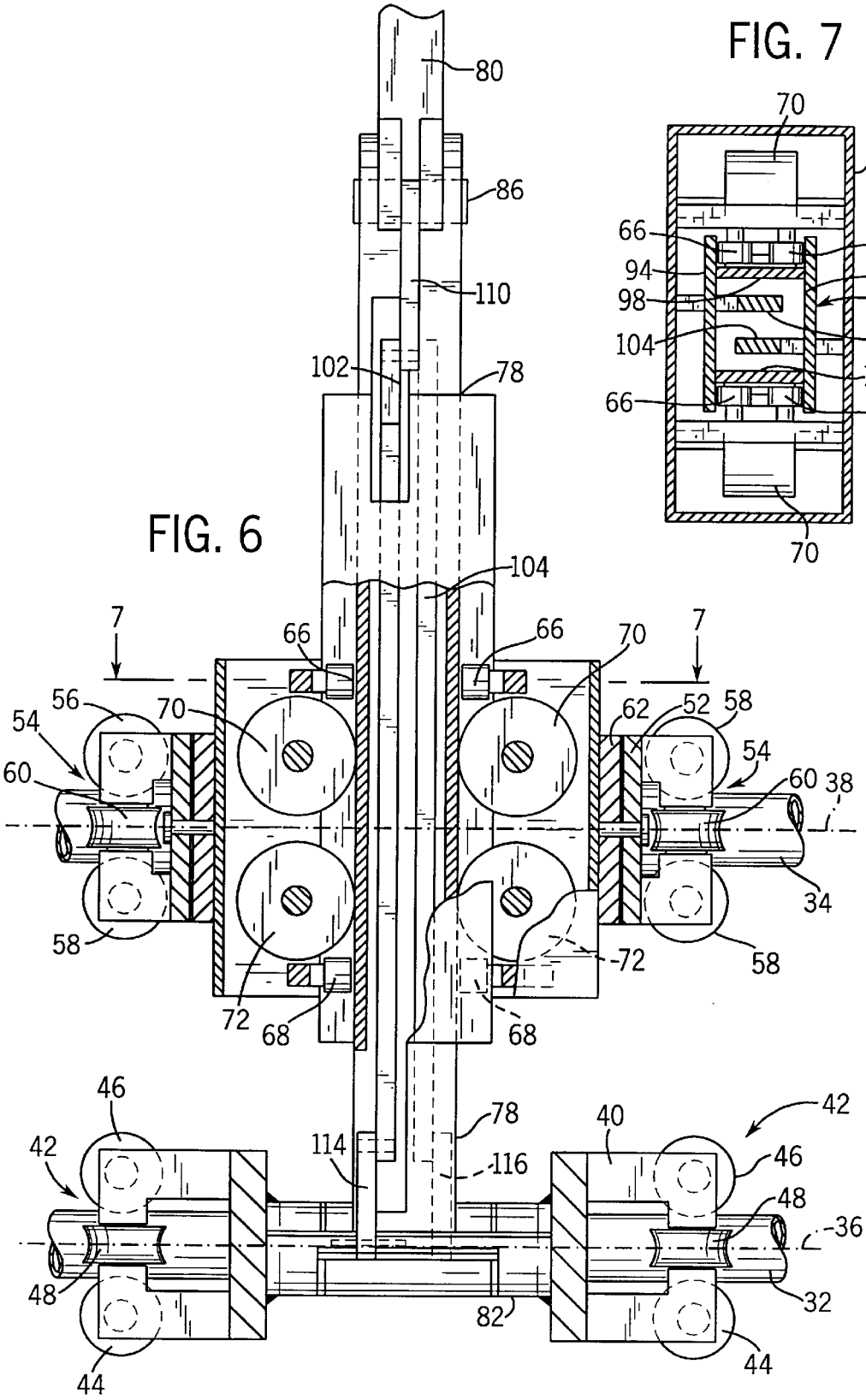
FIG. 6 is an enlarged, partial sectional view, with parts broken away, depicting the rollable mounting of a primary chassis along a lower track; a secondary chassis and fulcrum along an upper track and a strut arrangement slidably supported in the fulcrum.
Figure 7:
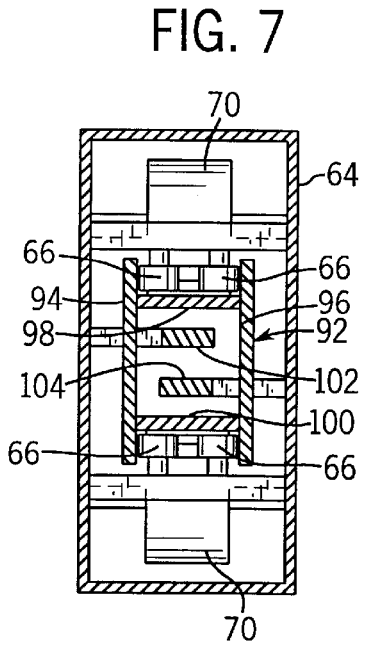
FIG. 7 is a sectional view taken on line 7—7 of FIG. 6.

As best seen in FIGS. 2 and 6, a lower or primary chassis 40 is rollably supported along each of the lower tracks 32 by fore and aft bogie arrangements 42, defined by upper rollers 44, lower rollers 46, and lateral rollers 48. Such bogie arrangements are well known in the art and no further detail is deemed necessary. An upper or secondary chassis 52 is similarly rollably supported along each of the upper tracks 34 by fore and aft bogie arrangements 54 defined by upper rollers 56, lower rollers 58 and lateral rollers 60.

A fulcrum 64 of rectangular cross section (FIG. 6,7) is pivotably mounted in secondary chassis 52 about upper track center line 38 by means of a bearing 62. Mounted inside the fulcrum 64 is a set of aligned upper pinch rollers 66 and a set of aligned lower pinch rollers 68. In addition, the fulcrum 64 carries a set of aligned upper support rollers 70 and a set of aligned lower support rollers 72, which are located between the pinch rollers 66,68.

A cantilevered, jointed or articulated strut arrangement 74 supports a passenger-carrying ride vehicle 76 away from the upper track structure 18 and secondary chassis 52, and links the primary chassis 40 and secondary chassis 52 together. The jointed strut arrangement 74 includes a lower tubular strut section 78 and an upper tubular strut section 80. The lower strut section 78 has a bottom end which is pivotably anchored by means of bearings 82 to the primary chassis 40 at a first pivot point 84 lying approximately along the lower track center line 36. The lower strut section 78 extends upwardly through the fulcrum 64 and has a top end pivotably connected at a second pivot point 86 to a lower end of the upper strut section 80. A top end of the upper strut section 80 typically projects into a radial slot 88 formed in the ride vehicle 76 and is pivotably secured at a third pivot point 90 on the ride vehicle 76. The lower strut section 78 includes a flanged box-beam 92 (FIGS. 6,7) having a pair of parallel, flanged walls 94,96 engageable with the upper and lower pinch rollers 66,68 in fulcrum 64. The box-beam 92 has a pair of parallel transverse walls 98,100 which connect the flanged walls 94,96 and are engageable with the upper and lower support rollers 70,72 in the fulcrum 64. The rollers 66,68,70,72 enable the lower strut section 78 to slide back and forth through the fulcrum 64. Although the lower strut section 78 is shown in its preferred embodiment as a box-beam construction, it could also have a tubular structure that cooperates with the rollers, as described above.

With reference to FIG. 3, the lower strut section 78 includes a pair of sliding push rods 102,104, each of which has an enlarged upper end 106 and a similarly shaped lower end 108. It should also be noted that because the upper strut section 80 carries no internal components like push rods 102,104, it does not necessarily have to be of a tubular construction. A pair of upper link arms 110,112, respectively, pivotably connect the upper ends 106 of the push rods 102,104 to the upper strut section 80 in the vicinity of the second pivot point 86. Similarly, a pair of lower link arms 114,116 pivotably connect the lower ends 108 of the push rods 102,104 to the bearings 82 for rotation with respect to primary chassis 40 in a plane perpendicular to the track centerline 36. The push rod and link arm construction provides a pantographic action translating motion from the lower portion of the system 10 to the upper strut section 80 and ride vehicle 76 in a manner to be further described below.

In order to advance ride vehicle 76, the primary chassis 40, the secondary chassis 52, the fulcrum 64 and the strut arrangement 74 along an axis of forward travel, a drive mechanism 118 (FIG. 1) is provided. Referring back to FIG. 1, the bottom of primary chassis 40 carries a rotatable and ratchetable cog wheel 120 which is engageable with a driven chain 122. It should be appreciated that other suitable drive mechanisms may include linear induction motors, multiple coil drives, electric motors, pinch roller systems, and other suitable propelling devices alone or in combination with gravity and centrifugal forces. Although not shown, it should be understood that various brake means can be provided in the roller coaster system, as is well known in the art.

In FIGS. 1 and 2, a scenic shell S is interposed between the ride vehicle 76 and the remainder of the system 10 in an effort to keep the track structure away from the passengers' primary sight line. Unlike traditional roller coasters, the remote mounting of the ride vehicle 76 is purposely designed to give a passenger the sensation of being in a vehicle which is capable of creating the impression of free flight. This impression can be further enhanced through the use of themed theatrical scenery, light, sound and special effects.

In addition, it has been discovered that, in accordance with the invention, the distance and the angular position of the ride vehicle 76 relative to the track structures 16,18 can be varied in response to the changing curvature and/or the gauge of the track structures over the travel path. Further, by varying the rotational position or roll angle of the lower track structure on its own center line, the pantographic strut linkage will cause an angular acceleration of the ride vehicle about the fulcrum pivot, the magnitude of acceleration being determined by the rate of change of the roll angle. In turn, this behavior permits the ride vehicle 76 to be accelerated in unexpected ways and along an arc of movement different from other roller coaster designs.

Figures 4, 5:
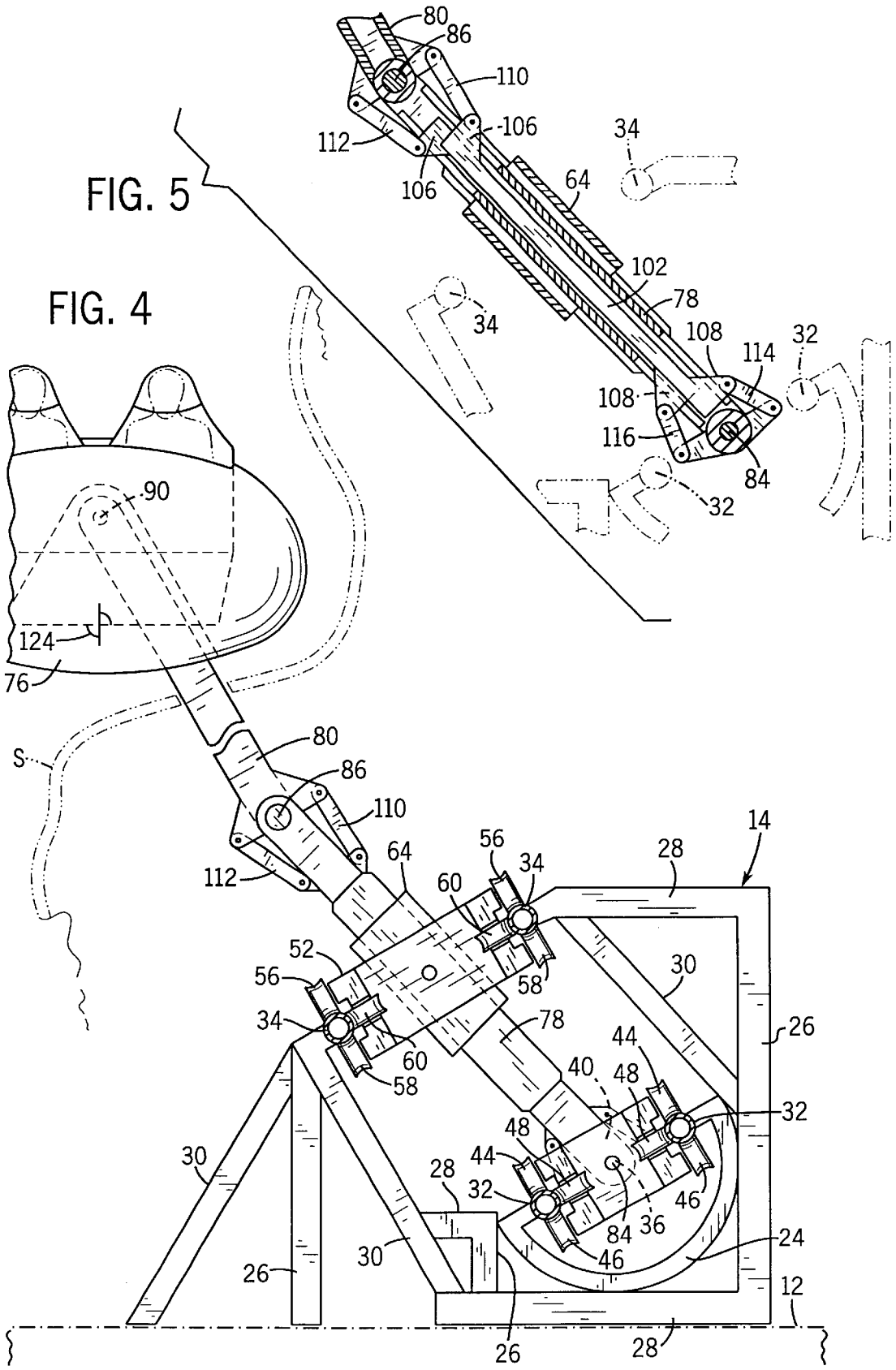
FIG. 4 is an elevational view similar to FIG. 2 illustrating the changing position of the roller coaster system resulting from changes in gauge and roll of its track structure.
FIG. 5 is a view similar to FIG. 3, but showing the sliding push rod and linkage structure in FIG. 4.

FIGS. 4 and 5 illustrate the operation of the roller coaster system 10 as the gauge and roll of the lower and upper tracks 32,34 change with respect to one another from the configuration shown in FIG. 1. It should be noted that FIGS. 4 and 5 may depict either straight or curved track segments. According to the existing shape of the track structure or, in this case, as the curvature of the tracks 32,34 changes, the distance between the track center lines 36,38 varies. In addition, the primary chassis 40 is angularly rotated through a roll angle around the lower track center line 36. Because the primary chassis 40 is connected with the sliding push rods 102,104 and lower links arms 114,116, corresponding motion is translated by means of the previously described pantograph structure to the upper strut section 80 and the ride vehicle 76. In addition, the lower strut section 78 will slide through the fulcrum 64 simultaneously as the fulcrum 64 pivots on the secondary chassis 62 to change the distance and angular position of the ride vehicle 76 relative to the lower and upper track structures 16,18. As a result of the repositioning of the ride vehicle 76, the scenic shell S is reconfigured so as to maintain the concealment of the track structure.

It is an important feature of the invention that, as the distance between the track center lines 36,38 changes, and in particular as the vertical curvature of the lower track changes to effect a progressive change in gauge between the track centerlines, the rate of acceleration along an axis perpendicular to the axis of forward motion is correspondingly affected. It should likewise be understood that the angle of the upper strut section 80 relative to a longitudinal center line of the lower strut section 78 is varied by a progressive change in the rotational position or roll angle of the lower track 32 and the primary chassis 40. This causes the ride vehicle 76 to accelerate through a circular arc about the second pivot point 86, the acceleration being determined by the rate of change of the roll angle.

As the ride vehicle 76 moves through the horizontal curves in the track, it is subject to centrifugal forces. However, the center of gravity at 124 is designed to allow the ride vehicle 76 to come easily enough to rest at a normal upright position. If necessary, this action may be mechanically regulated or dampened as desired by conventional damping devices known in the art.

FIGS. 8–13 illustrate additional embodiments of the present invention which operate in a similar manner as described with reference to FIGS. 1–7.

Figure 9:
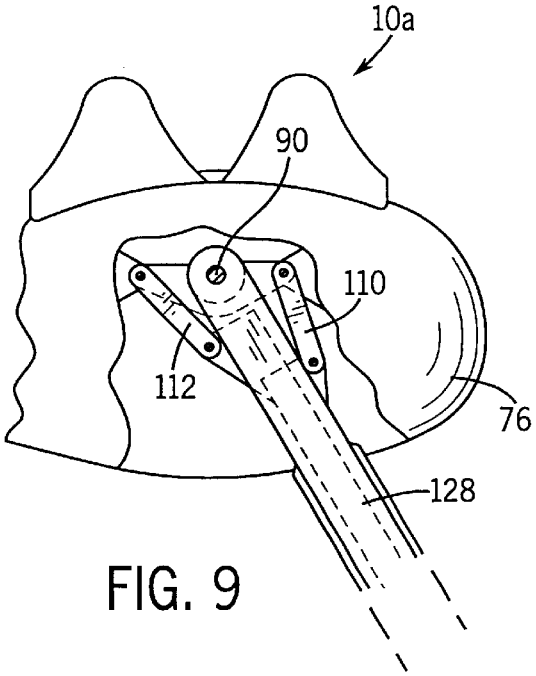
FIG. 9 is a partial view showing the changing position of the alternative embodiment shown in FIG. 8.
Figure 8:
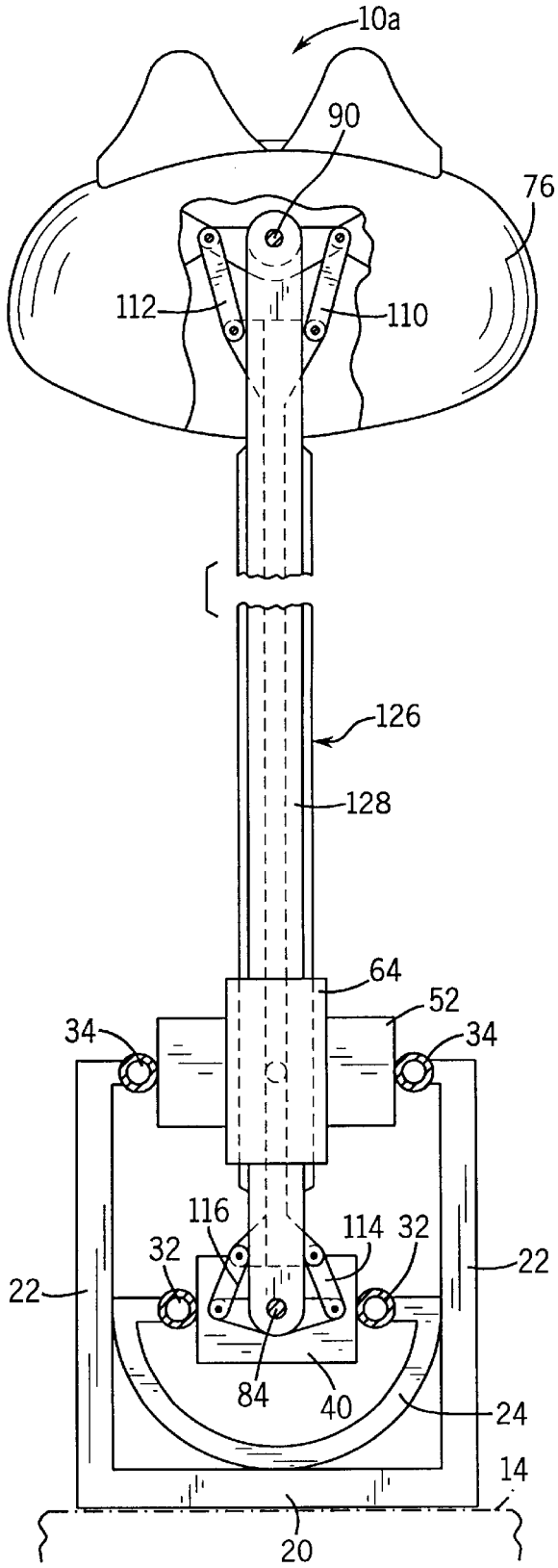
FIG. 8 is a view similar to FIG. 2 showing a first alternative embodiment of the invention.
Figure 13:
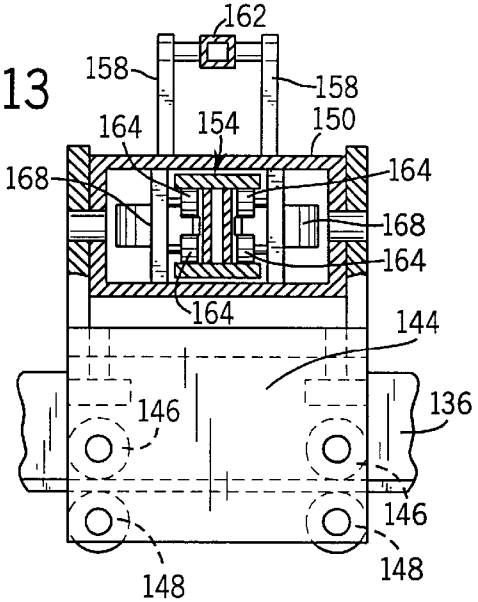
FIG. 13 is a partial, sectional view taken on line 13—13 of FIG. 12.
Figure 12:
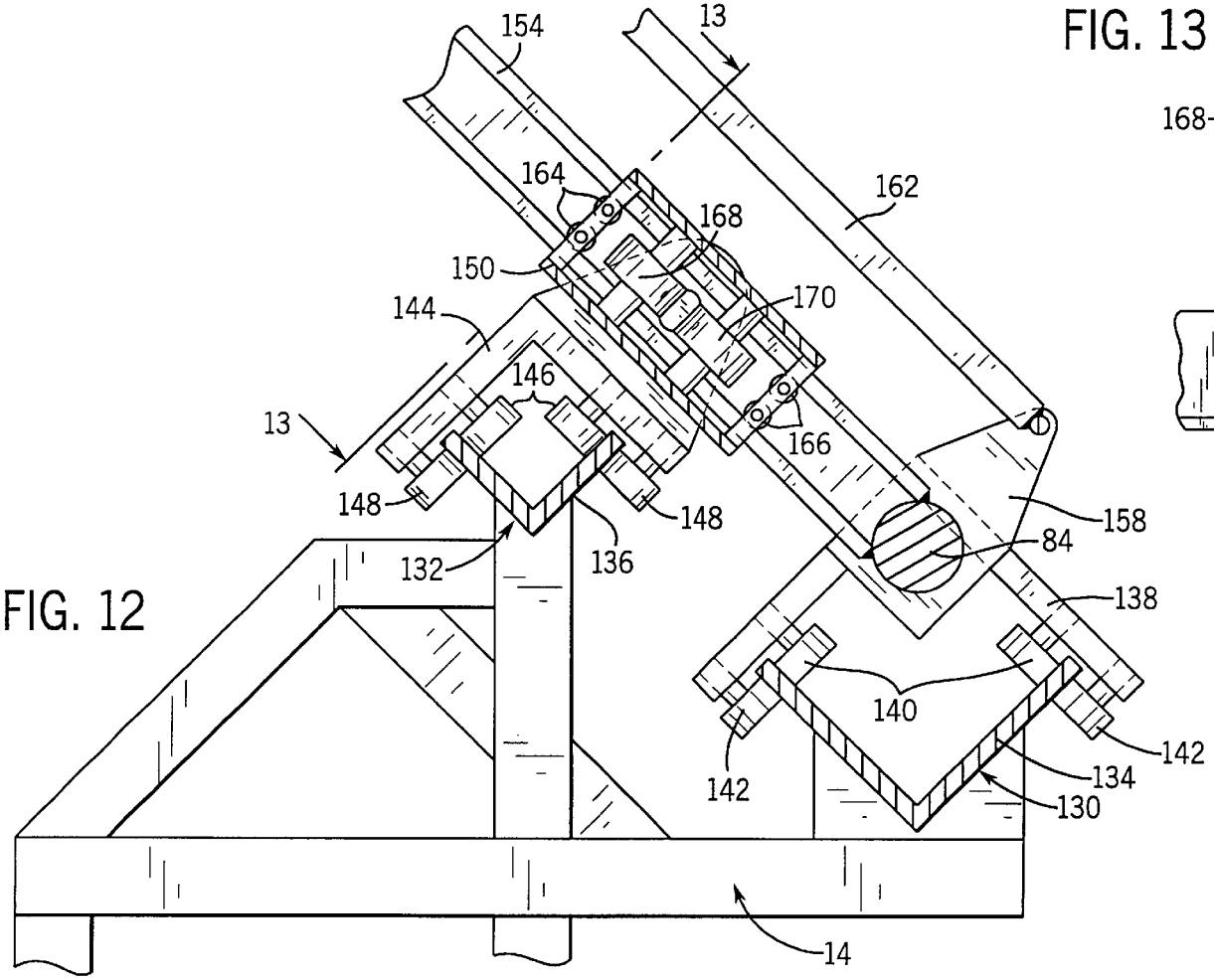
FIG. 12 is an enlarged, partial, sectional view showing the details of the lower structure shown in FIG. 10.

FIGS. 8 and 9 show a first alternative embodiment of the invention which is similar to the preferred embodiment of FIGS. 1–7 and will be explained using like reference numerals where possible. In place of the jointed strut 74, roller coaster system 10*a* employs a strut arrangement 126 having a singular tubular strut 128 having a bottom end joined to the primary chassis 40 at the first pivot point 84, as previously described, and a top end extending into the radial slot 88 in the ride vehicle 76 and pivotally attached at the third pivot point 90 directly to the ride vehicle 76. The interior of the strut 128 has a push rod and link arm structure as previously described except that the upper link arms 110,112 are attached directly to the ride vehicle 76.

FIGS. 10–13 show a second alternative embodiment of the invention wherein the lower and upper track structures 130,132, respectively, of roller coaster system 10*b* are each comprised of a single lower track 134 and a single upper track 136, both of which are V-shaped in cross section. Lower track 134 is fixedly mounted to support structure 14 by gussets 135. Upper track 136 is anchored to the top of vertical members 137 in the support structure 14. A primary chassis 138 is rollably supported by upper and lower rollers 140,142, respectively, along the upper edge of the lower track 134. A secondary chassis 144 is rollably mounted by upper and lower rollers 146,148, respectively, on the upper edges of the upper track 136. A fulcrum 150 is pivotally mounted to the second chassis 144. The jointed strut arrangement 152 is comprised of a lower strut section 154 pivotally mounted to an upper strut section 156. The fulcrum 150 slidably receives the lower strut section 154 having a bottom end pivotably attached at first pivot point 84 to the primary chassis 138, and an upper end pivotably attached at second pivot point 86 to a lower end of the upper strut section 156. An upper end of the upper strut section 156 preferably projects into the radial slot 88 on the ride vehicle 76, and is pivotably attached thereto at third pivot point 90. However, another type of pivotal connection could be used as well. Instead of the push rod and link arm structure previously described, this embodiment employs a pair of lower bell cranks 158 pivotably attached to the primary chassis 138, a pair of upper bell cranks 160 pivotably secured to the upper strut section 156, and an elongated link arm 162 extending substantially parallel to the lower strut section 154 and interconnecting the bell cranks 158,160. The bell cranks 156,158 and link arm 162 provide the same pantographic motion as described above. Lower strut section 154 is rollably supported in fulcrum 150 by upper and lower pinch rollers 164,166, respectively, and upper and lower support rollers 168,170, respectively.

It should now be fully appreciated that the primary chassis 40,138, the secondary chassis 52,144, the fulcrum 64,150, and the strut arrangement 74,126,152 in the respective embodiments define a unique, motion translation arrangement for simultaneously varying the distance and angular position of the ride vehicle 76 in response to the changing gauge and relative rotational position or roll angle between the upper and lower tracks over the travel path. A specific geometric configuration for the ride may be determined by either the thematic/dynamic requirements of a particular design, by restrictions imposed on the track system by the structure housing the ride and/or its site. With the present invention, the ride designer is given the flexibility to conceal the ride track from the view of the vehicles' passengers over a wide range of surrounding angle and distance from the axis of vehicle travel. The net effect of the roller coaster system 10,10*a*,10*b* of the present invention is to present the passenger with an exhilarating ride experience approximating free flight.

In the roller system 10,10*a*,10*b*, the ride vehicle distance away from the upper track 34,136 may be varied along an axis of movement which is perpendicular to the axis of forward motion by changing the gauge between the upper and lower tracks. The rate of acceleration along this perpendicular axis may be controlled by the rate of change of the gauge between the upper tracks 34,136 and the lower tracks 32,134 over the course of the travel path. In addition, for the roller systems 10 and 10*b*, the angle of the upper strut section 80,156 supporting the ride vehicle 76 relative to the ground and the track system may be varied by changing the roll angle of the lower tracks 32,134 acting upon the primary chassis 40,138 which, in turn, acts upon the upper strut section 80,156 and the ride vehicle 76. As a result, the ride vehicle 76 will accelerate through a circular arc about the second pivot joint 86 between the upper strut section 80,156 and the lower strut section 78,154, the amount of acceleration being determined by the rate of change of the roll angle. These unique axial and circular movements of the ride vehicle may be imparted simultaneously, and may be provided concurrently with more conventional ride vehicle movement through vertical and horizontal curves common to prior art roller coasters.

In certain applications, it may be desirable to provide a system with a pair of parallel and closely spaced strut arrangements, the strut arrangements being of either a double strut type (e.g. FIG. 4) or a single strut type (e.g. FIG. 8). In either arrangement, the strut pairs would be mounted to pass together through a single enlarged fulcrum. At each of the pivots, the strut pairs would be secured together for common rotational movement and held apart by fixed spacers. This modified ride structure would provide increased strength and resistance to possible torsional forces imparted by the ride vehicle.

Various alternatives and embodiments are contemplated as being within the scope of the following claims particularly pointing out and distinctly claiming the subject matter regarded as the invention. For example, while the specification portrays the roller coaster system as being supported on a horizontal plane such as the ground, it should be understood that the present invention could also be adapted to be suspended from a horizontal plane or might be anchored to a supporting surface in a vertical plane.

I claim:

1. An amusement ride comprising:

a lower track structure operatively connected with and variably spaced from an upper track structure to define a path of travel having a changing lower track roll angle and a changing gauge;

a ride vehicle supported remote from the track structure;

a motion translation arrangement located between the track structure and the ride vehicle for varying an angular position and distance of the ride vehicle relative to the track structure in response respectively to the changing lower track roll angle and changing gauge of the track structure over the travel path; and a drive mechanism for moving the motion translation arrangement and the ride vehicle along the track structure.

2. The amusement ride of claim 1, wherein the lower track structure includes a pair of parallel lower tracks and the upper track structure includes a pair of parallel upper tracks, the lower and upper tracks having respective center lines spaced apart a variable distance over the path of travel.

3. The amusement ride of claim 2, wherein each of the lower and upper tracks is tubular and has a circular cross section.

4. The amusement ride of claim 2, wherein the motion translation arrangement includes:

a primary chassis supported for rolling movement along the lower tracks, a secondary chassis supported for rolling movement along the upper tracks, a fulcrum pivotably mounted relative to the secondary chassis, and a strut arrangement having a lower end pivotably attached to the primary chassis and an upper end pivotably connected to the ride vehicle, the strut arrangement being mounted for reciprocal sliding movement through the fulcrum.

5. The amusement ride of claim 4, wherein the primary chassis and the secondary chassis are supported along their respective lower and upper tracks by a set of upper, lower and lateral rollers.

6. The amusement ride of claim 4, wherein the strut arrangement is comprised of an upper strut section, and a lower strut section pivotably anchored at a bottom end to the primary chassis at a first pivot point lying generally along the lower track center line and extending upwardly through the fulcrum, the lower strut section having a top end pivotably connected at a second pivot point to a lower end of the upper strut section, the upper strut section having an upper end pivotably connected to a third pivot point on the ride vehicle.

7. The amusement ride of claim 6, wherein the angle of the upper strut section supporting the ride vehicle relative to the lower strut section is varied by the angular rotation of the primary chassis relative to the lower strut section causing the ride vehicle to accelerate through a generally circular arc about the second pivot point, the acceleration being determined by the rate of change of the angular rotation.

8. The amusement ride of claim 6, wherein the strut section includes a pair of sliding push rods, each of the rods having an upper end and a lower end, a pair of upper link arms pivotally connecting the upper ends of the push rods to the upper strut section, and a pair of lower link arms pivotally connecting the lower ends of the push rods to the primary chassis in a pantographic arrangement, whereby said changing roll angle causes angular rotation of the primary chassis relative to the lower strut section around the lower track center line, which rotation is translated to the upper strut section and the ride vehicle.

9. The amusement ride of claim 4, wherein the primary chassis is provided with a rotatable and ratchetable cog wheel which is engageable with a driven link chain to form the drive mechanism for moving the motion translation arrangement and the ride vehicle along the lower and upper track structure.

10. The amusement ride of claim 1, wherein the ride vehicle has a center of gravity arranged to permit the ride vehicle to come to rest in an upright position when free of centrifugal forces that are exerted in a curve of the travel path.

11. The amusement ride of claim 6, wherein the lower strut section includes a flanged, box-beam having a pair of parallel flanged walls engageable with a set of upper and lower pinch rollers mounted inside the fulcrum, and a pair of transverse walls connecting the flanged walls and engageable with a pair of upper and lower support rollers mounted inside the fulcrum between the pinch rollers.

12. The amusement ride of claim 4, wherein the strut arrangement is comprised of a single tubular strut section having a bottom end pivotably anchored at a first pivot point to the primary chassis and extending upwardly through the fulcrum, the single strut section having a top end pivotably attached at a second pivot point to the ride vehicle.

13. The amusement ride of claim 12, wherein the interior of the single strut section includes a pair of sliding push rods, each of the rods having an upper end and a lower end, a pair of upper link arms pivotably connecting the upper ends of the push rods to the ride vehicle, and a pair of lower link arms pivotably connecting the lower ends of the push rods to the primary chassis in a pantographic arrangement permitting any angular rotation of the primary chassis around the lower track center line to be translated to the ride vehicle.

14. The amusement ride of claim 1, wherein the lower track structure and the upper track structure are V-shaped in cross section.

15. The amusement ride of claim 14, wherein the motion translation arrangement includes:

a primary chassis supported for rolling movement along the lower track structure;

a secondary chassis supported for rolling movement along the upper track structure;

a fulcrum pivotably mounted relative to the secondary chassis, and a strut arrangement having a lower end pivotably attached to the primary chassis and an upper end pivotably attached to the ride vehicle, the strut arrangement being mounted for sliding movement back and forth through the fulcrum.

16. The amusement ride of claim 15, wherein the strut arrangement is comprised of an upper strut section and a lower strut section pivotably anchored to the bottom end of the primary chassis at a first pivot point lying approximately along the lower track structure center line and extending upwardly through the fulcrum, the lower strut section having a top end pivotably connected at a second pivot point to a lower end of the upper strut section, the upper strut section being pivotably connected at a third pivot point on the ride vehicle.

17. The amusement ride of claim 16, including a pair of upper bell cranks mounted to the upper strut section, a pair of lower bell cranks attached to the primary chassis, and an elongated link arm lying substantially parallel to the lower strut section and joined between the upper bell cranks and the lower bell cranks.

18. The amusement ride of claim 17, wherein the primary chassis and the secondary chassis are supported along their respective lower and upper track structures by a set of upper and lower rollers.

19. A cantilevered roller coaster system, comprising:

a support structure for supporting a lower track structure and an upper track structure, the lower and upper track structures defining a path of travel, each of the lower and upper track structures having a respective center line spaced apart by a gauge distance over the path of travel, said lower track having a variable rotational position with respect to its center line along the path of travel to define a changing roll angle;

a ride vehicle supported remote from the upper and lower track structure;

a primary chassis supported for movement along the lower track structure;

a secondary chassis supported for movement along the upper track structure;

a fulcrum pivotally mounted relative to the secondary chassis;

a strut arrangement having a lower end pivotably attached to the primary chassis and an upper end pivotably connected to the ride vehicle, the strut arrangement being mounted for sliding movement back and forth through the fulcrum, and a drive mechanism for moving the ride vehicle, the primary chassis, the secondary chassis, the fulcrum and the strut arrangement relative to the lower and upper track structure, whereby, a change in the rotational position of the primary chassis corresponding to the changing roll angle of the lower track structure on its center line changes the angular position of the ride vehicle relative to the upper and lower track structures, and a change in the gauge distance causes the strut arrangement to slide through the fulcrum and changes the distance between the ride vehicle and said track structures.

20. A roller coaster amusement ride comprising a dual track structure having upper and lower tracks and respective center lines therefor;

said center lines defining a gauge distance that changes along the length of said dual track, said lower track having a variable rotational position with respect to its center line along the length of said lower track to define a changing roll angle;

respective upper and lower chassis mounted for movement along said tracks:

a motion translation arrangement interconnecting the upper and lower chassis at one end and carrying a ride vehicle at the other end;

said motion translation arrangement being operative in response to the changing roll angle of the lower track and to changes in gauge distance between said tracks to respectively vary an angular position of the ride vehicle relative to the track structure and a distance between the ride vehicle and the track structure.

* * * * *